US005651337A

United States Patent [19]

Regueiro

[11] Patent Number: 5,651,337

[45] Date of Patent: Jul. 29, 1997

[54] CARRIER FOR CAMSHAFT AND TAPPET SUPPORT

[75] Inventor: Jose F. Regueiro, Rochester Hills, Mich.

[73] Assignee: Chrysler Corporation, Auburn Hills, Mich.

[21] Appl. No.: 694,723

[22] Filed: Aug. 9, 1996

[51] Int. Cl.[6] ..... F02F 7/00

[52] U.S. Cl. ..... 123/90.27; 123/193.3; 123/193.5; 123/195 H

[58] Field of Search ..... 123/90.19, 90.22, 123/90.23, 90.27, 90.38, 193.3, 193.5, 195 H

[56] References Cited

U.S. PATENT DOCUMENTS

| | | | |
|---|---|---|---|
| 5,080,057 | 1/1992 | Batzill et al. | 123/90.27 |
| 5,150,675 | 9/1992 | Murata | 123/193.5 |
| 5,195,472 | 3/1993 | Jacques et al. | 123/90.33 |
| 5,207,197 | 5/1993 | Klingmann et al. | 123/195 R |
| 5,213,071 | 5/1993 | Iwata et al. | 123/90.27 |
| 5,339,778 | 8/1994 | Reckzugel et al. | 123/193.5 |
| 5,435,281 | 7/1995 | Regueiro | 123/195 H |
| 5,507,259 | 4/1996 | Tanaka | 123/193.5 |

*Primary Examiner*—Weilun Lo

*Attorney, Agent, or Firm*—Kenneth H. MacLean

[57] ABSTRACT

A tappet and camshaft carrier that includes expansion bars which directly interconnect adjacent bulkhead members to compensate for the differential rate of thermal expansion between the carrier and the base to which the carrier is fastened.

8 Claims, 6 Drawing Sheets

84
106
114
124
128
122
74
146
66
150
152
114
126
90
120
68
148
112
110
138
116
82
128
150
152
114
124
120
70
146
114
84'
108
126
122
76
102

CARRIER FOR CAMSHAFT AND TAPPET SUPPORT

FIELD OF THE INVENTION

This invention concerns internal combustion engines having two part cylinder heads and, more particularly, relates to a tappet and camshaft carrier containing temperature compensating expansion bars and forming one part of the cylinder head.

BACKGROUND OF THE INVENTION

My U.S. Pat. No. 5,435,281 which issued on Jul. 25, 1995 discloses a cylinder head for an internal combustion engine with a base component formed from iron for providing the upper end of the combustion chamber, the intake and exhaust ports and support for the intake and exhaust valves, fuel injector or spark plug. A one-piece tappet and camshaft carrier made of aluminum alloy is attached to the base and includes open lattice work of interconnected segments to support the tappets for operation therein and camshaft supporting bulkheads integral with the lattice work. The bulkheads are spaced and interconnected by the lattice work that includes thermal expansion and contraction joints located so that the wide range of temperature variations occurring during engine operation does not cause damage to the lattice work or the bulkheads.

Another support-frame construction devised as a tappet and camshaft carrier for attachment to a base portion of an internal combustion engine's cylinder head can be seen in U.S. Pat. No. 5,080,057 issued on Jan. 14, 1992 in the name of Batzill et al. The Batzill et al. patent is directed to a die cast and machined carrier comprising upper and lower sections secured to a cylinder head housing. When installed, the two-part carrier forms a web-like structure of ribs, struts and annular sections for receiving and slidably supporting inverted bucket tappets of the intake and exhaust valves and for rotatably supporting the camshafts above the tappets. This multi-part carrier provides a cylinder head assembly of high rigidity with the camshaft and tappets operatively mounted thereon. However, a thermal expansion or contraction function is not provided by the Batzill et al. carrier.

SUMMARY OF THE INVENTION

The present invention has certain similarities to the two-piece cylinder head constructions described in the above-mentioned patents in that a tappet and camshaft carrier is provided as one part of a cylinder head for an internal combustion engine. However, this invention differs structurally from the above-described tappet and camshaft carriers in that it not only provides support for the camshaft and tappet but also serves to support the rocker shaft which, in turn, is adapted to support a plurality of rocker arms. Another important difference between the carrier according to this invention and the carriers seen in the above-described patents is that the carrier has each of its bulkhead members integrally formed with a bearing portion adapted to rotatably support a camshaft to one side of the tappets. Moreover, this tappet and camshaft carrier includes a series of bulkhead members with the bearing portions formed with cylindrical openings which are axially aligned and progressively smaller in diameter so as to allow the camshaft to be inserted axially into the cylindrical openings and be retained therein by a thrust plate secured to the first bulkhead member.

More specifically, the tappet and camshaft carrier made in accordance with the present invention is made of a first metallic material having a first coefficient of thermal expansion. The carrier is adapted to be fastened to a base forming a part of the cylinder head of an internal combustion engine and which is made from a second metallic material having a second coefficient of thermal expansion which is less than that of the first metallic material. The carrier comprising laterally spaced bulkhead members adapted to be rigidly secured to the base of the cylinder head and has cylindrical tappet guides integrally formed with each of the bulkhead members. A ring-shaped bearing portion is integrally formed at one end of each of the bulkhead members and has a cylindrical opening therein adapted to support a camshaft for rotation about an axis substantially normal to the longitudinal axis of the associated bulkhead member. The bearing portion of each of the bulkhead members has a shoulder formed therewith between the bearing portion's cylindrical opening and the tappet guides for supporting a rocker shaft. In addition, a pair of expansion bars are secured to and extend between adjacent bulkhead members. In the preferred form, each of the pair of expansion bars are formed with a "U" shaped loop portion and is designed to flex in a limited region of stress and strain so as to act as an elastic portion of the carrier to compensate for the differential rate of thermal expansion or contraction between the carrier and the base.

One object of the present invention is to provide a new and improved tappet and camshaft carrier that includes expansion bars which directly interconnect adjacent bulkhead members to compensate for the differential rate of thermal expansion or contraction between the carrier and the base to which the carrier is fastened.

Another object of the present invention is to provide a new and improved tappet and camshaft carrier provided with a ring-shaped bearing portion at one end of a bulkhead member for supporting a camshaft and formed with a shoulder that serves to support a rocker shaft.

A further object of the present invention is to provide a new and improved tappet and camshaft carrier made of an aluminum alloy and adapted to be fastened to an iron base which forms one part of a cylinder head and in which its bulkhead members directly support tappet guides and are bounded on opposite sides by a pair of expansion bars which interconnect adjacent bulkhead members.

A still further object of the present invention is to provide a new and improved tappet and camshaft carrier having a plurality of bulkhead members each of which is integrally formed with a bearing portion adapted to rotatably support a camshaft to one side of the tappets which are directly formed with each of the bulkhead members.

A still further object of the present invention is to provide a new and improved tappet and camshaft carrier which includes a series of bulkhead members with bearing portions formed with cylindrical openings at one end of the bulkhead members and in which the cylindrical openings are axially aligned and progressively smaller in diameter so as to allow the camshaft to be inserted axially into the cylindrical openings and be retained therein by a thrust plate secured to the first bulkhead member.

BRIEF DESCRIPTION OF THE DRAWINGS

Other objects, advantages and features of the present invention will be apparent from a reading of the following detailed description when taken with the drawings in which.

DETAILED DESCRIPTION OF THE DRAWINGS

Figure 1:
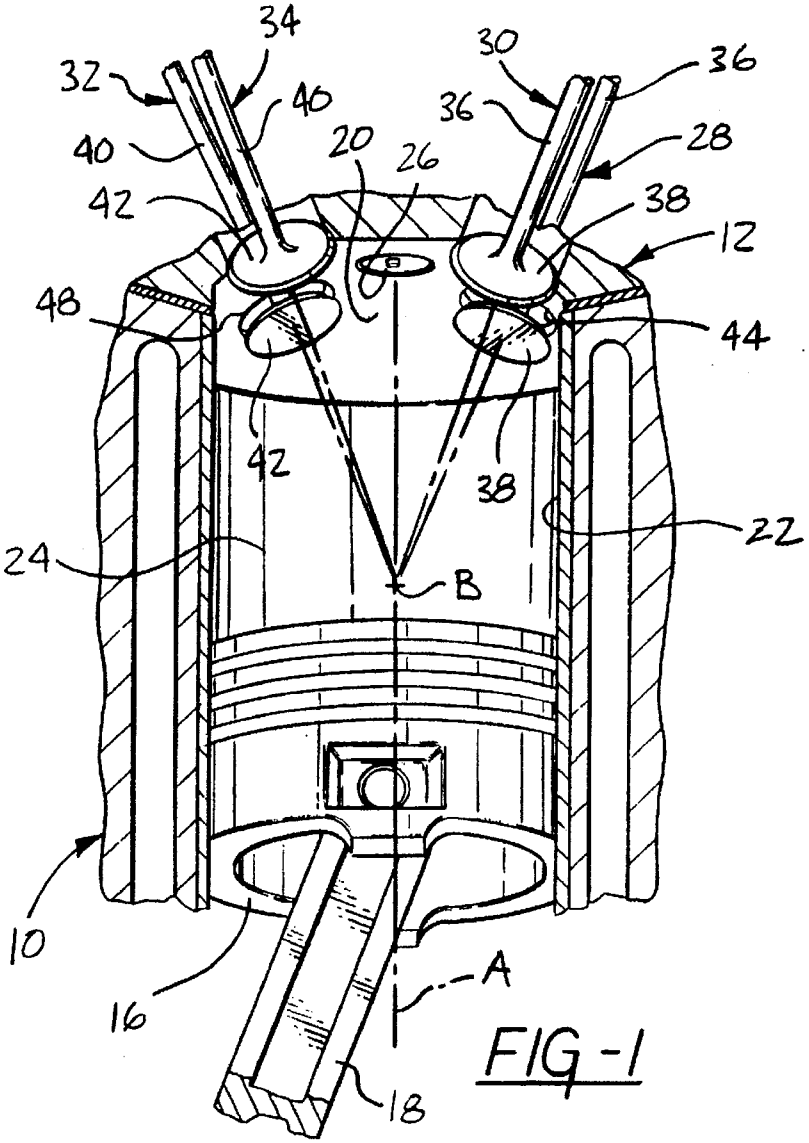
FIG. 1 is a perspective view of one cylinder of a multi-cylinder engine showing a pair of intake valves and a pair of exhaust valves actuated through an actuator system incorporated within a valve train mechanism a portion of which is supported in a tappet and camshaft carrier according to the present invention and seen in FIG. 2.

Referring now to the drawings and more particularly to FIG. 1 thereof, a perspective view of a single cylinder of a multi-cylinder engine is shown having an engine block 10 on which is secured by fasteners (not shown) a lower head portion of a two-piece cylinder head assembly 12. The cylinder head assembly 12 serves to support a valve train mechanism 14 which includes an actuator system 15 seen in FIG. 2.

Figure 3:
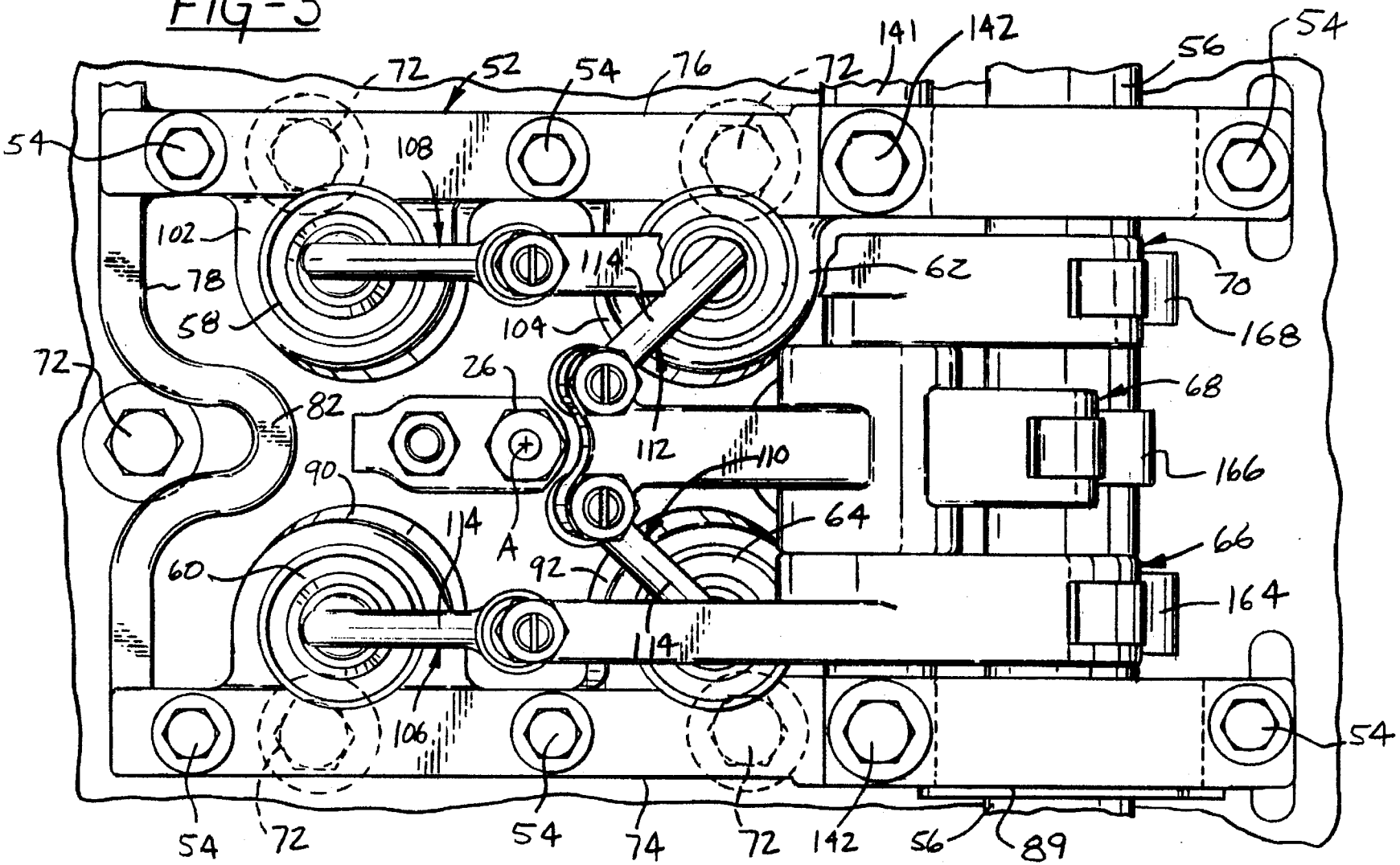
FIG. 3 is a plan view of the valve train mechanism seen in FIG. 2.

Each of the cylinders of the engine houses a piston 16 which moves axially along the longitudinal center axis A of the associated cylinder and has the lower end thereof connected to the engine crankshaft (not shown) by a connecting rod 18. The lower base portion 19 of the cylinder head assembly 12 is formed with a hemispherical surface 20 providing a recess which is aligned with the bore defining the associated cylinder 22 and together with the top of the piston 16 forms a combustion chamber 24 which varies in volume during the operation of the engine. In this instance, a diesel fuel injector 26 seen in FIG. 3 is secured in the cylinder head 12 centrally of the hemispherical surface or recess 20 along the longitudinal axis "A" of each cylinder 22. The fuel injector 26 is secured in position by a clamp and a nut tightened on a stud threadably secured to the lower base portion 19 of the cylinder head 12. As will become apparent hereinafter, the actuator system 15 forming a part of the valve train mechanism 14 can also be used with a spark ignition internal combustion engine in which case a spark plug would be substituted for the injector 26.

Figure 2:
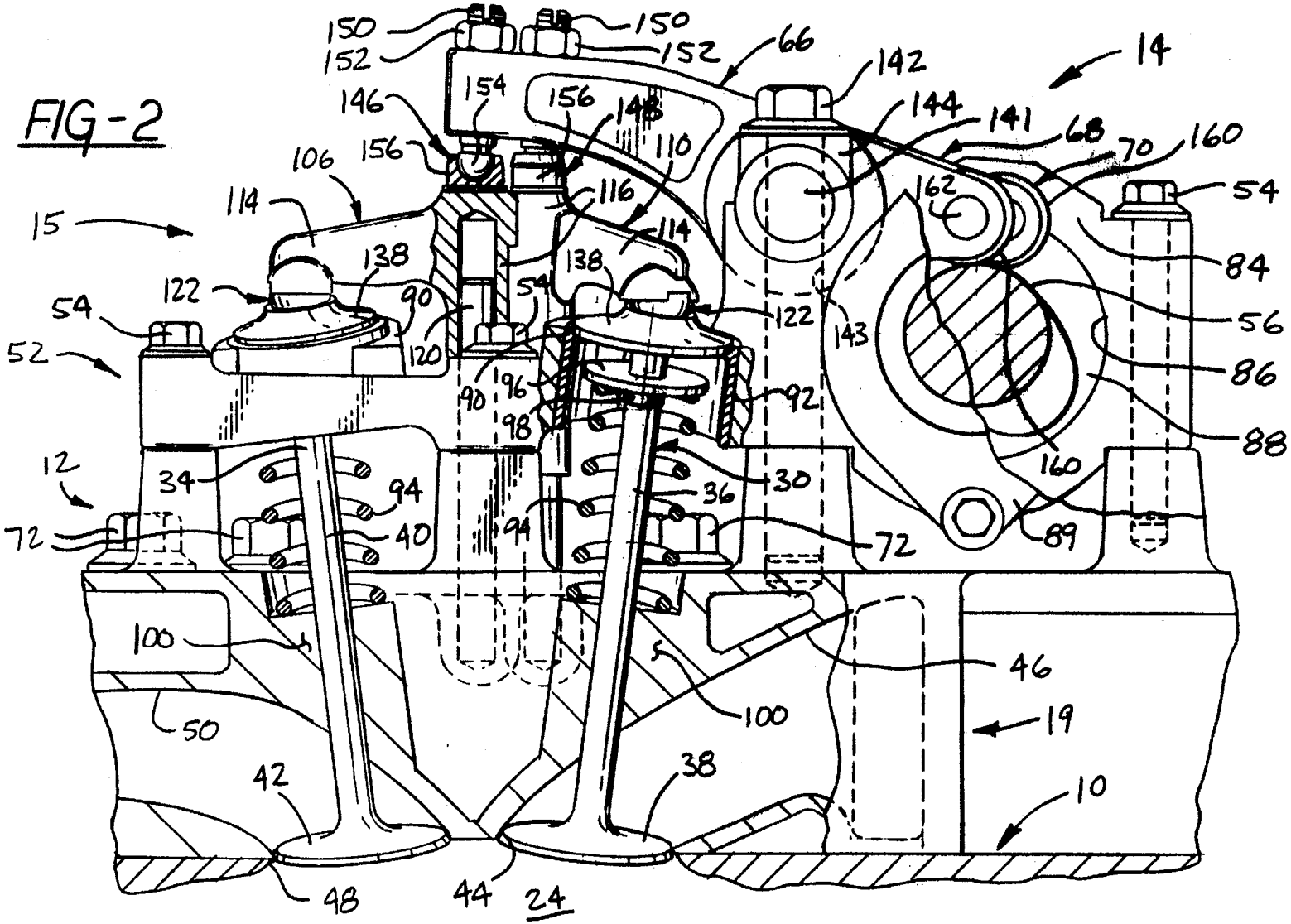
FIG. 2 is a view partially in section of a portion of the cylinder head showing one of the exhaust valves and one of the intake valves of FIG. 1 and an actuator system employed by a valve train mechanism for actuating the valves in accordance with the present invention.

As best seen in FIGS. 1 and 2, the cylinder head assembly 12 is provided with a pair of intake valves 28 and 30 and a pair of exhaust valves 32 and 34 which are located in side-by-side relationship extending along the longitudinal axis of the engine. Each of the intake valves 28 and 30 has a valve stem 36 the lower end of which is formed with a round valve head 38. Similarly, each of the exhaust valves 32 and 34 has a valve stem 40 the lower end of which is formed with a round valve head 42. As is conventional, each of the intake valve heads 38 is normally seated in a valve seat formed in the cylinder head that defines a round opening or port 44 of an intake passage 46 formed in the lower base portion 19 of the cylinder head assembly 12 as seen in FIG. 2. Also, each of the exhaust valve heads 42 are normally seated in a valve seat formed in the cylinder head 12 that defines a round opening or port 48 of an exhaust passage 50 also formed in the lower base portion 19 of the cylinder head assembly 12.

It will be noted that the valve stems 36 of the intake valves 28 and 30 and the valve stems 40 of the exhaust valves 32 and 34 are disposed radially or angularly about the cylinder head 12 such that the intersection of their longitudinal center axes occurs at a point "B" located on the longitudinal center axis "A" of the cylinder 22 as seen in FIG. 1. As a result, the centers of the valve heads 38 of the intake valves 28 and 30 and the centers of the valve heads 40 of the exhaust valves 32 and 34 are located on a common circle concentric with the periphery of the cylinder 22. In addition, in this case, the centers of the valve heads 38 and 42 are circumferentially equally spaced from each other. Also, each of the valve heads 38 and 42 is in an essentially tangential plane relative to the hemispherical recess 20. Thus, as seen in FIG. 1, the longitudinal centerline of each valve 28–34 is canted at an equal angle to both the longitudinal and transversal planes of the engine. This orientation not only allows for more room at the top of the cylinder 22 and lessens the space requirements for valves, spark plugs, injectors, precombustion chambers or cooling water jackets, but also produces a far superior combustion chamber with optimum central location of the spark plug or injector. It will be understood that for practical considerations the valves 28–34 may be disposed with different angles on longitudinal and transversal planes so that the point "B" may not fall on the longitudinal center axis "A".

Referring again to FIG. 2, it will be noted that this figure is an elevational sectional view of the cylinder head 12 taken along a plane extending transversely of the engine and shows the exhaust valve 34 and the intake valve 30 seen in FIG. 1 and the actuator system 15 employed by the valve train mechanism 14 for actuating the valves. Inasmuch as the engine block 10 and the various operating components normally associated therewith are well known to those skilled in the art of engine design, a detailed showing and/or description of such parts and components is not being provided herein. Instead, the valve train mechanism 14 and the parts associated therewith will be described below in detail. In addition, it will be noted that in describing the structure of the cylinder head assembly 12 and the valve train mechanism 14, only the parts associated with one cylinder of the engine block 10 will be described in detail and it will be understood that similar and identical parts are associated with each of the other cylinders of the engine block 10.

As seen in FIGS. 2–5, the cylinder head assembly 12 includes the lower base portion 19 which is generally rectilinear and preferably made of cast iron. The cylinder head assembly 12 also includes a tappet and camshaft carrier 52 made in accordance with the present invention. The carrier 52, which is preferably made of an aluminum alloy, is secured to the base portion 19 by a plurality of bolts 54 and 142, and serves to support a camshaft 56, inverted bucket tappets 58, 60, 62, 64 for each valve, and rocker arms 66, 68 and 70 as will be more fully explained hereinafter, for each cylinder. The base portion 19, in turn, is fastened to the upper end of the engine block 10 by a plurality of head bolts 72 which extend through the body of the base portion 19 into threaded holes (not shown) formed in the engine block 10. Although not shown, a pair of laterally spaced and parallel side walls may be integrally formed with the base portion 19 and extend upwardly and, together with a valve cover (not shown) plus corresponding front and back walls, serve to enclose the carrier 52 and the valve train mechanism 14. As seen in FIG. 2, the air intake passage 46 and the exhaust passage 50 are provided in the base portion 19 and terminate respectively at the ports 44 and 48 which, in turn, communicate with the combustion chamber 24.

As best seen in FIGS. 3 through 6, the carrier 52 for one cylinder of the engine is formed by fore and aft spaced bulkheads 74 and 76. The bulkheads 74 and 76 are interconnected by a pair of laterally spaced expansion bars 78 and 80 each of which has the midsection thereof formed with a "U" shaped loop portion 82. Each of the bars 78 and 80 are of relatively thin uniform cross section and are designed to flex in a limited region of stress and strain so that they act as an elastic portion of the carrier 52 to compensate for the differential rate of thermal expansion or contraction between the aluminum alloy of the carrier 52 and the iron base portion 19 of the cylinder head assembly 12.

Figure 6:
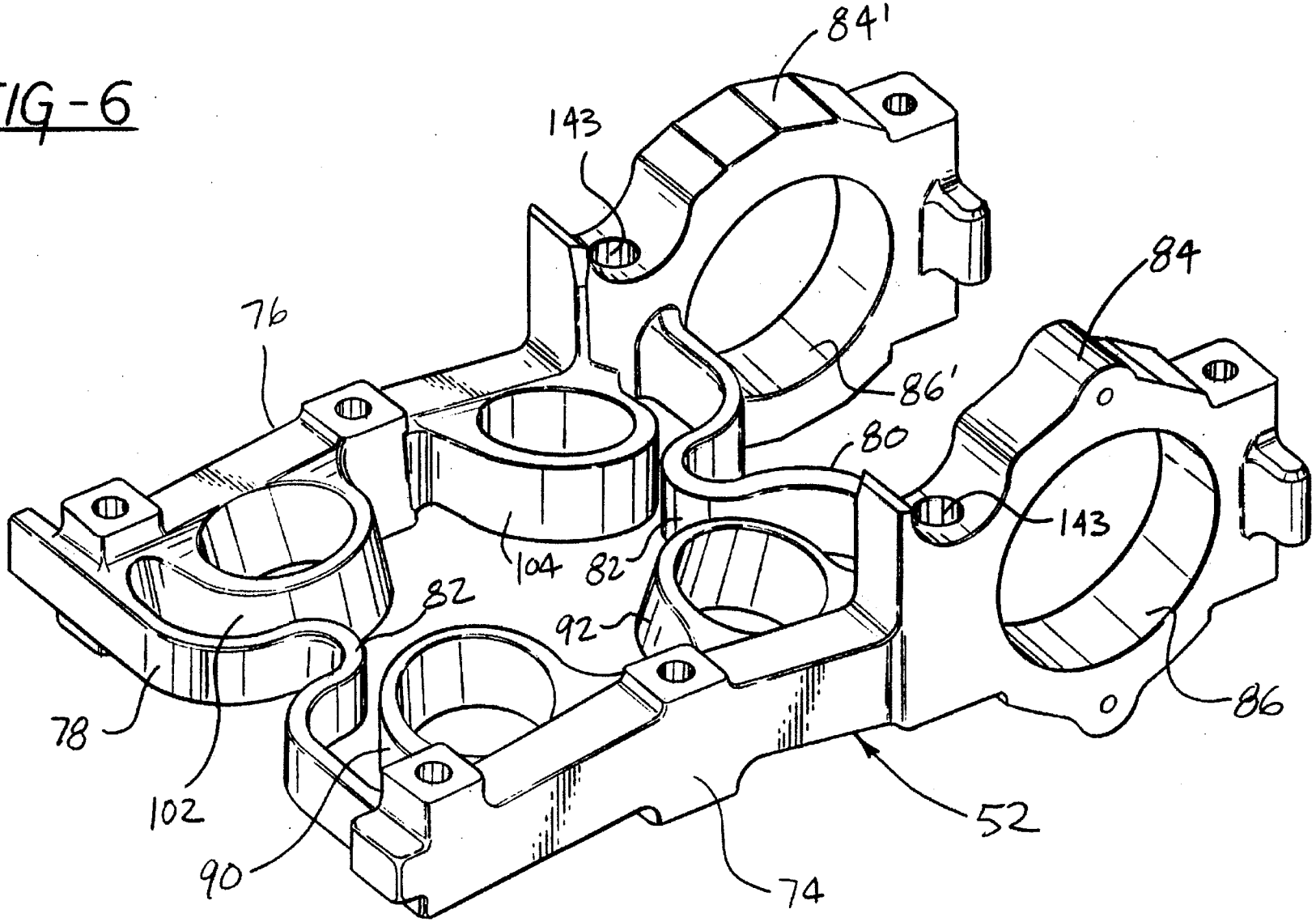
FIG. 6 is a perspective view of the carrier which supports the tappets, camshaft and the rocker shaft for the rocker arms.

In addition, each of the bulkheads 74 and 76 is integrally formed with a ring-shaped bearing portion 84 at one end thereof which is provided with a cylindrical opening 86 in which the journal portion 88 of the camshaft 56 is supported for rotation. As seen in FIG. 6, it will be noted that the cylindrical opening 86' in the bearing portion 84' of the bulkhead 76 has a smaller diameter than the cylindrical opening 86 of the bulkhead 74. Similarly, the journals 88 of the camshaft which are located in the cylindrical openings 86, 86' of the bulkheads 74 and 76 will have an outer diameter appropriately sized so that they fit into the accommodating cylindrical openings 86. This allows the camshaft 56 to be readily inserted axially into the cylindrical openings 86 of the carrier 52. The bulkheads (not shown) positioned adjacent the cylinders of the engine 10 to the rear of the bulkhead 76 will also have cylindrical openings which are progressively smaller so as to allow the camshaft 56 to be inserted axially into the bearing portions and retained axially by a thrust plate 89 seen in FIG. 2 in combination with the camshaft gear or sprocket (not shown). This arrangement also facilitates the machining process by using stepped tooling.

With further reference to FIGS. 3 and 6, it will be noted that the expansion bar 78 serves to interconnect the other end of the bulkheads 74 and 76 while the bar 80 interconnects the bearing portions 84 and 84'. If desired, another expansion bar could be used to interconnect the bearing portions 84 and 84' either below the openings 86 and 86' or to the right of the openings 86 and 86' as seen in FIG. 6. As should be apparent, not only do the expansion bars serve to compensate for the differential rate of thermal expansion and contraction between the carrier 52 and the base portion 19, but also allow the carrier 52 to be made as a one-piece unit for ease of manufacture.

The bulkhead 74 is located at the front end of the engine and is directly integrally formed with a pair of laterally spaced and cylindrically shaped tappet guides 90 and 92. As seen in FIGS. 2 and 3, the tappet guide 90 supports the inverted bucket tappet 60 which is in contact with the upper end of the valve stem 40 of the exhaust valve 34 for movement along the longitudinal center axis of the associated valve stem 40. Similarly, the tappet-guide 92 supports the inverted bucket tappet 64, which is in contact with the upper end of the valve stem 36 of the intake valve 30, for movement along the longitudinal center axis of the associated valve stem 36. Both the exhaust valve 34 and the intake valve 30 are each biased into a closed position by a coil compression spring 94 the upper end of which abuts a retainer 96 secured to the valve stem by a conventional two-piece lack 98. The lower end of each of the springs 94 is located within a spot-faced recess on the top deck of a valve stem guide 100 which is integrally formed with the base portion 19 and supports the associated valve for reciprocal movement.

Figure 4:
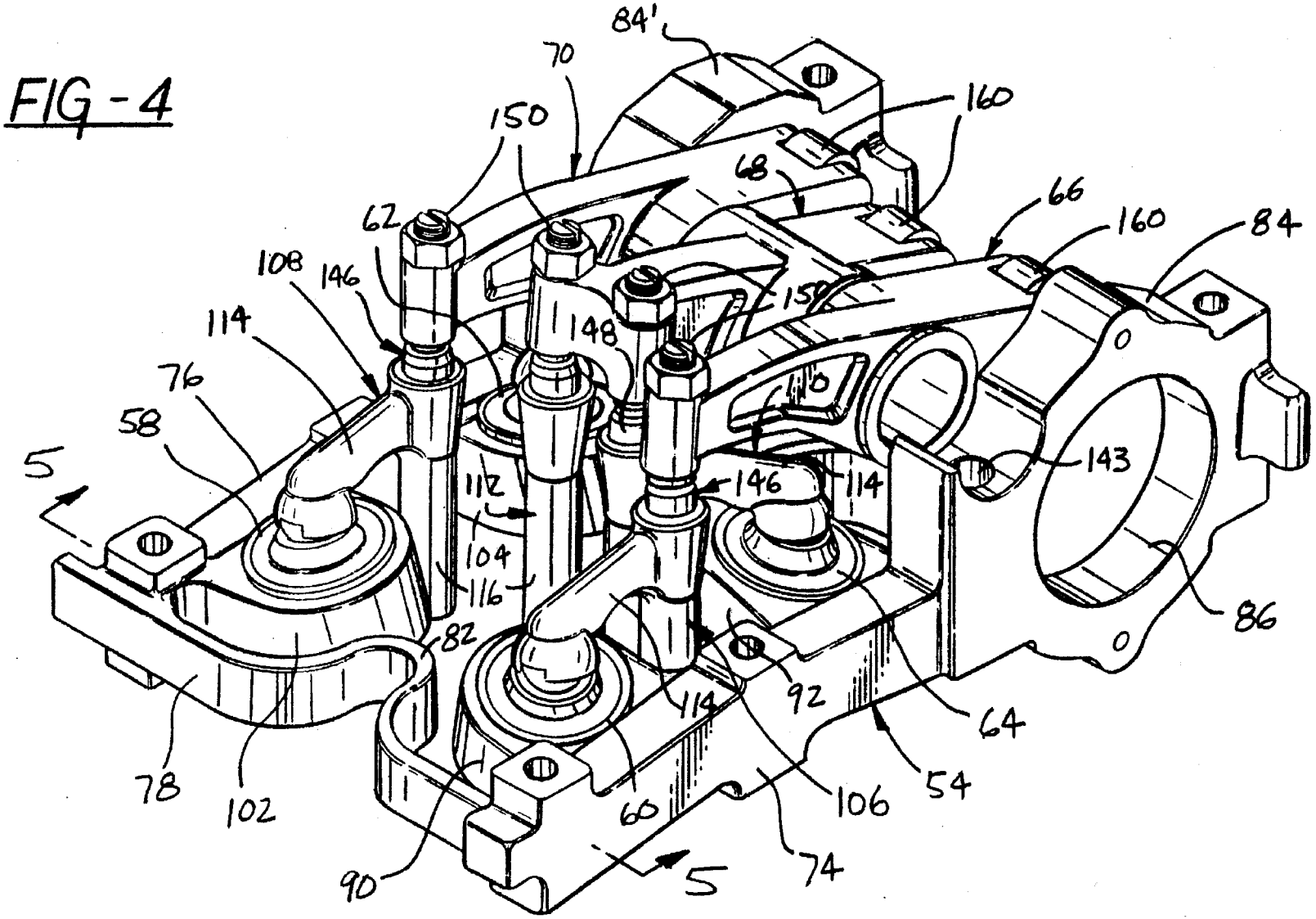
FIG. 4 is a perspective view of the valve train mechanism seen in FIGS. 2 and 3 with certain parts thereof removed so as to simplify the disclosure for clarity purposes.

As seen in FIGS. 3 and 4, the bulk-head 76 is integrally formed with a tappet guide 102 supporting the inverted bucket tappet 58 associated with the exhaust valve 32 for movement along the longitudinal center axis of the associated valve stem 40. In addition, a tappet guide 104 integrally formed with the bulkhead 76 supports the inverted bucket tappet 62 associated with the intake valve 28 for movement along the longitudinal center axis of the associated valve stem 36. Similarly, the exhaust valve 32 and the intake valve 28 are supported in the base portion 19 by parts corresponding to the parts supporting the exhaust valve 34 and intake valve 30 as seen in FIG. 2. In addition, although not shown, it will be understood that the bulkhead 76 has tappet guides such as tappet guides 90 and 92 integrally formed on the side opposite the tappet guides 102 and 104 for the intake and exhaust valves associated with the cylinder to the rear of cylinder 22. Similar bulkheads with two sets of tappet guides would be provided between the other cylinders and the last bulkhead would be a mirror image of the front bulkhead 74.

With reference to FIGS. 3 and 6 once again, it will be noted that the expansion bar 78 serves to interconnect the end of the bulkheads 74 and 76 opposite the end which includes the bearing portion. Also, the expansion bar 80 interconnects the bearing portions 84 and 84'. Moreover, the tappet guides 90, 92, 102, and 104 are located between the two expansion bars 78 and 80.

By positioning the expansion bars 78 and 80 as described above, during engine operation under elevated temperature conditions, the forces of expansion occurring in the carrier 52 will not be transmitted to the bulkheads with any magnitude that would cause tilting or displacement thereof. Accordingly, the bearing portions 84 and 84' for the camshaft 56 of the bulkheads are not disturbed and remain in alignment with the camshaft 56 so that there is no undue friction and wear. Also, the flexing of the expansion bars 78 and 80 prevents distortion of the tappet guides so that they continue the effective operation of the valve train mechanism.

Figure 7:
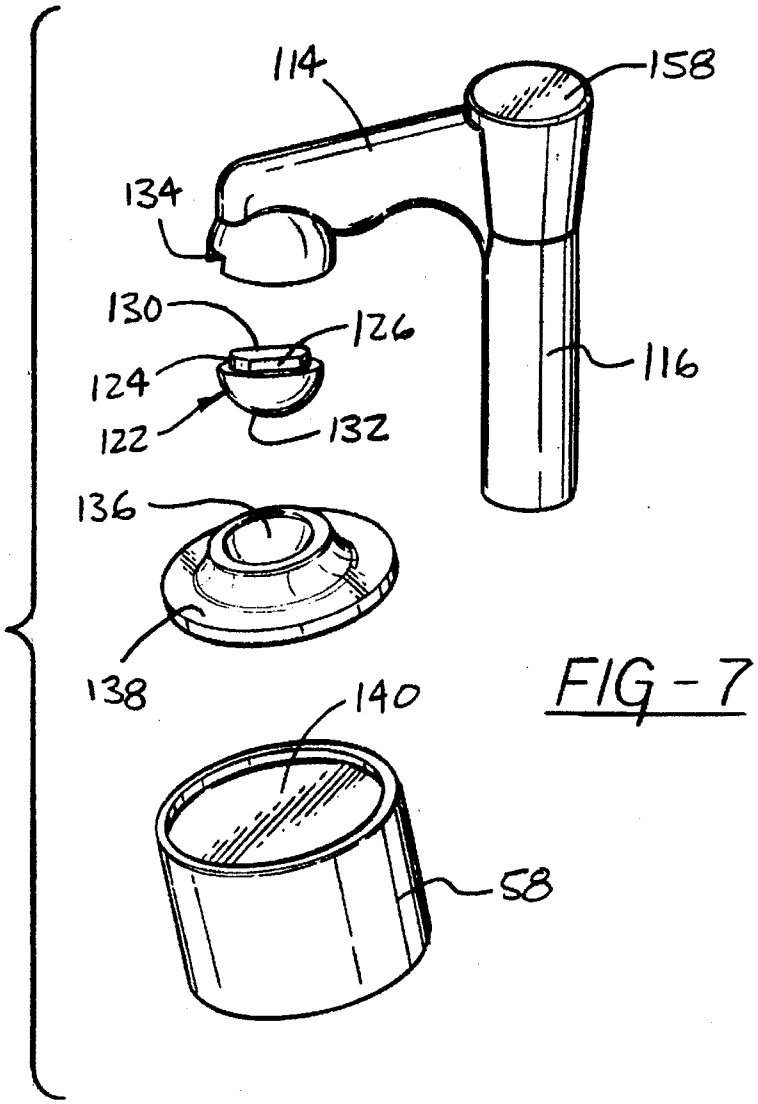
FIG. 7 is an exploded view of one of the actuators forming a part of the valve train mechanism seen in FIGS. 2–5.

As seen in FIGS. 1–5, opening of the exhaust valves 32, 34 and the intake valves 28, 30 against the bias of the associated springs 94 is controlled through the actuator system 15 which in this case includes four identical "L" shaped actuators 106, 108, 110, and 112 each of which, as shown in FIG. 7, comprises an arm portion 114 integrally formed with a leg portion 116. The leg portion 116 of each of the actuators 106–112 is provided with a flat top surface 118 and is supported for reciprocal movement by a guide pin 120 the lower end of which is fixed to the top deck of the base portion 19. The longitudinal center axis of each guide pin 120 is positioned parallel to the axis "A" of the cylinder 22.

Figure 5:
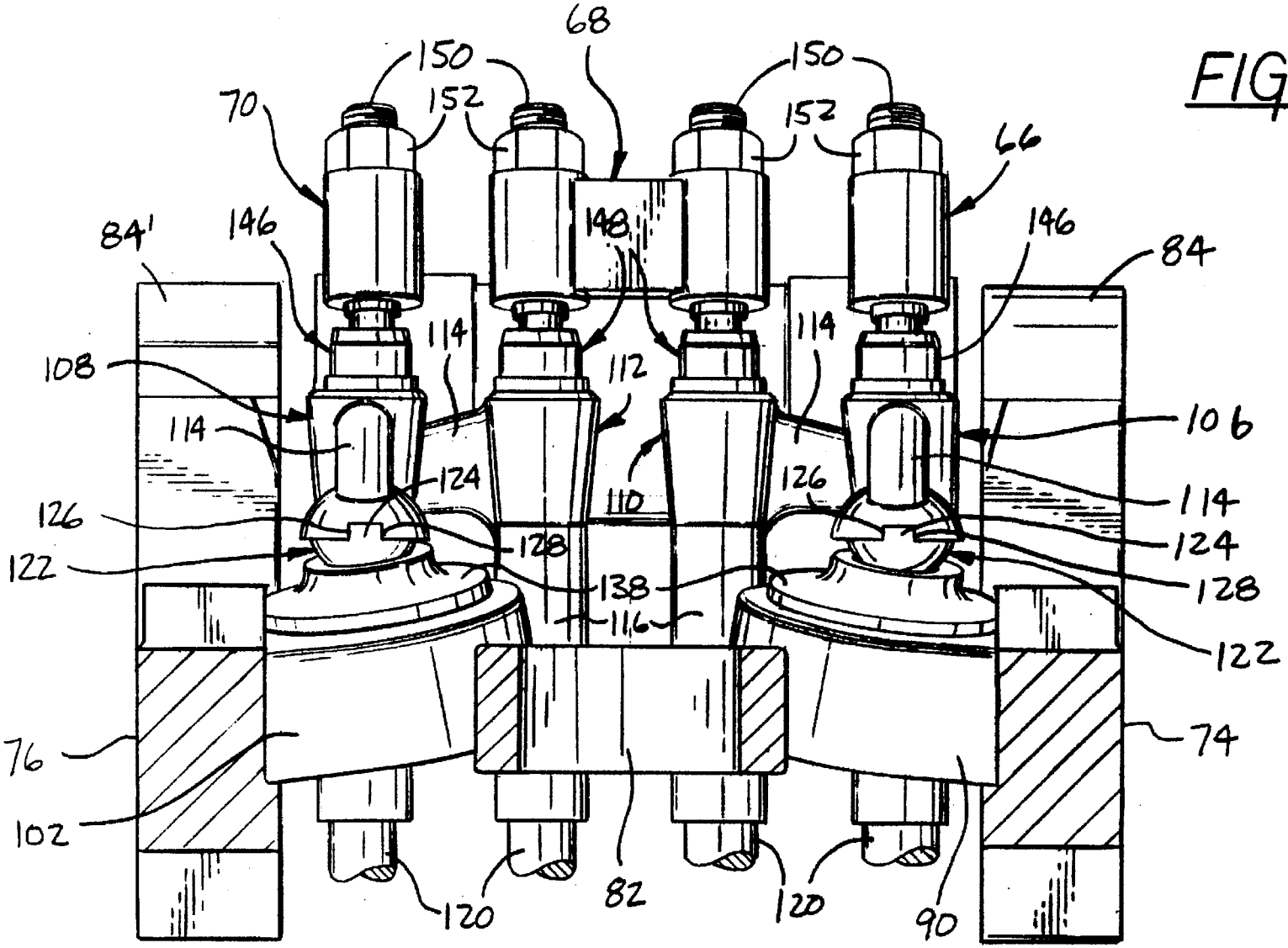
FIG. 5 is a view taken on line 5—5 of FIG. 4.

The head end of each arm portion 114 of the actuators 106–112 is provided with a combination spherical and sliding joint. Thus, as seen in FIG. 4, a combination spherical and sliding joint is positioned between the actuator 106 and the inverted bucket tappet 60, between the actuator 108 and the inverted bucket tappet 58, between the actuator 110 and the inverted bucket tappet 64, and between the actuator 112 and the inverted bucket tappet 62. As seen in FIGS. 5 and 7, the combination spherical and sliding joint, in each instance, is the same in construction and includes a half-ball member 122 having an integral upwardly extending tongue 124 defined by a pair of spaced flat and parallel side walls 126 and 128 and a flat top wall 130 which is located in a plane normal to the associated side walls 126 and 128. The half-ball member 122 also includes a spherical lower surface 132. The top portion of the tongue 124 of the half-ball member 122 is slidably received by a slot 134 formed in the head end of the arm portion 114. The slot 134 is "U" shaped and of uniform cross section and extends along the longitudinal axis of the associated arm portion. The lower spherical surface 132 of the half-ball member 122 is located within a spherical recess 136 centrally formed in a socket member 138 which is formed as a separate disc member centrally positioned within a circular recess 140 in the top of the associated inverted bucket tappet. As an alternative, the socket member 136 can be made integral with the top of the associated inverted bucket tappet.

The actuators 106–112 are operated by the rocker arms 66–70 which are supported for oscillation by a rocker shaft 141 secured to one shoulder of the bearing portion of each of the bulkheads 74 and 76 by a bolt 142 which extends through a cap 144, through the rocker shaft 141, and through the corresponding hole 143 in each bulkhead 74, 76 into a threaded opening (not shown) in the base portion 19. The rocker arms 66 and 70 are mirror images of each other with the tail end portion of each being provided with a spherical joint 146 of the type frequently referred to as an "elephant foot". On the other hand, the rocker arm 68 is somewhat shorter in length than the rocker arms 66 and 70 and has the tail end thereof provided with a dual-end arrangement supporting a pair of spherical joints 148 which are identical in construction to the spherical joint 146 of the rocker arms 66 and 70. In this regard and as seen in FIG. 2, each of the spherical joints 146 and 148 includes an adjusting screw 150 the shank portion of which is threaded into the tail end of the associated rocker arm and is secured thereto by a locknut 152. The lower end of the adjusting screw 150 is integrally formed with a ball portion 154 captured within a spherical recess of a socket member 156 having a flat lower contact surface in relative slidable engagement with the flat top surface 118 of the associated actuator. The screws 150 serve to individually set the lash-adjustment for each valve actuating mechanism.

Thus, as seen in FIGS. 4 and 5, the spherical joint 146 of the rocker arm 66 rests on the flat top surface 118 of the leg portion 116 of the actuator 106 while the spherical joint 146 of the rocker arm 70 rests on the flat top surface 118 of the leg portion 116 of actuator 108. Also, the two spherical joints 148 of the rocker arm 68 rests on the flat top surface 118 of the actuators 110 and 112.

The head-end portion of each rocker arm 66, 68, and 70 is provided with a roller 160 supported for rotation by a shaft 162 fixed to the associated rocker arm. As seen in FIGS. 2 and 3, the rollers 160 of the rocker arms 66, 68, and 70 are in rolling contact with cam lobes 164, 166, and 168, respectively, formed on the overhead camshaft 56. Both the camshaft 56 and the rollers 162 are each supported for rotation about an axis which is substantially parallel to the rotational axis of the engine crankshaft. Also, the longitudinal center axis of the rocker shaft 141 about which the rocker arms 66–70 oscillate is parallel to the rotational axes of the rollers 160 and the camshaft 56.

It will be noted that each of the guide pins 120 associated with the actuators 106–112 and the valves 28–34 are strategically located so as to realize an efficient operation of the valve train mechanism 14 and provide sufficient space for the spark plug in the case of a spark ignition engine and for the fuel injector in the case of a compression ignition engine. Thus, as seen in FIG. 3, the center of the guide pin 120 of the actuator 106 is located along a line interconnecting the center of the half-ball member 122 of the actuator 106 and the center of the half-ball member 122 of the actuator 110. Similarly, the center of the guide pin 120 of the actuator 108 is located along a line interconnecting the center of the half-ball member 122 of the actuator 108 and the center of the half-ball member 122 of the actuator 112. Also, as seen in FIG. 3, the center of the guide pin 120 of the actuator 110 is located along a line interconnecting the center "A" of the cylinder 22 and the center of the half-ball member 122 of the actuator 110. In addition, the center of the guide pin 120 of the actuator 112 is located along a line interconnecting the center axis "A" of the cylinder 22 and the center of the half-ball member 122 of the actuator 112. This "folded back" motion arrangement of the rocker arm 68 and actuators 110, 112 allows the proper rocker arm ratio and physical disposition of all of the valve train components including the injector within the limited space provided for each cylinder over the cylinder head.

Accordingly, with the guide pins 120 of the actuators 106–112 being positioned as described above, and as the camshaft 56 rotates in timed sequence to the associated engine crankshaft, the tail end of the rocker arms 66 and 70 will be pivoted downwardly as seen in FIG. 2 when the rollers 160 are contacted by the lift portions of the cam lobes 164 and 168 to open the exhaust valves 32 and 34 and provide communication between the combustion chamber 24 and the exhaust passage 50. Inasmuch as the center of the tappet moves radially towards the center of the cylinder, the tail end of each of the rocker arms 66 and 70 moves along an arc while each of the associated actuators 106 and 108 (under the urging of the rocker arms 66 and 70) moves downwardly along a straight line defined by the longitudinal center axis of the guide pin 120. During this motion, the socket member 156 of the spherical joint 146 of each rocker arm 66 and 70 will slide in the transversal plane relative to the associated actuator. At the same time, as the actuators 106 and 108 are moved downwardly by the rocker arms 66 and 70, the combination spherical joint and sliding connection between each of the actuators 106, 108 and the associated inverted bucket tappets 58, 60 serves to compensate for the skewed movement of the tappets towards point "B" as seen in FIG. 1. Since each of the inverted bucket tappets 58, 60 experiences a compound movement during this time, the associated actuator also experiences a compound movement due to the position of the guide pin 120. In other words, each of the actuators 106 and 108 not only moves in a downward direction along the associated guide pin 120 but, in addition, the arm portion 114 of each of the actuators 106 and 108 pivots about the associated guide pin 120 as indicated by the arrows in FIG. 3. This movement occurs because, as seen in FIG. 3, each inverted bucket tappet 58 and 60 moves downwardly along the longitudinal axis of the associated valve stem, so it also moves towards the center axis "A". This movement, in turn, causes the half-ball member 122 to slide within the slot 134 relative to the associated arm portion 114 in a direction towards the guide pin 120 of the associated actuator while the latter pivots about the guide pin 120. At the same time, the half ball member 122 within the accommodating spherical recess 136 compensates for the movement of the associated inverted bucket tappet along a path different from that followed by the downwardly moving arm portion 114 of each of the actuators 106 and 108, while it also rotates in relation to the socket member 138.

A somewhat different movement of each of the actuators 110 and 112 occurs when the lift portion of the cam lobe 166 causes downward movement of the tail end of the rocker arm 68 to open the intake valves 28 and 30 against the bias of the associated springs 94. In this regard, it will first be noted that sliding movement of the two spherical joints 148 relative to the flat top surfaces 118 of the actuators 110 and 112 occurs similar to that as explained above in connection with the rocker arms 66 and 70 and the actuators 106 and 108. In this instance, however, inasmuch as the longitudinal center axis of each arm portion 114 of each of the actuators 110 and 112 moves downwardly along a plane which passes through the longitudinal center axis of the valve stem 36 of the associated intake valve and axis "A", neither of the actuators 106 or 108 experience pivoting about their guide pin 120. The tongue 124 of the half-ball member 122 associated with each the actuators 110 and 112, however, experiences a sliding movement within the accommodating slot 134 towards the guide pin 120 of the associated actuator. In addition, the half-ball member 122 within the spherical recess 136 of each inverted bucket tappets 62 and 64 compensates for the different angle of motion of the actuator and the tappet. The actuators 110 and 112 move in a vertical plane while the tappet moves in a radial plane, that is, a combination of longitudinal and transversal planes. From a practical standpoint, the spherical joint allows simple and inexpensive manufacture of interchangeable parts which are not position-sensitive. In other words, the identical inverted bucket tappets 58–64, half-balls 122, socket members 138, and actuators can be installed in combination with any of the tappet guides 90, 92, 102, 104 at random, without matching. Furthermore, the ball and socket mechanisms also allow free rotation of the tappets 58–64 and sockets 138 about their own axis to minimize wear.

Various changes and modifications can be made to the above-described tappet and camshaft carrier without departing from the spirit of the invention. Accordingly, such changes and modifications are contemplated by the inventor and he does not wish to be limited except by the scope of the appended claims.

The embodiments of the invention in which an exclusive property or privilege is claimed are defined as follows:

1. A tappet and camshaft carrier of a first metallic material having a first coefficient of thermal expansion adapted to be fastened to a base forming a part of the cylinder head of an internal combustion engine and made from a second metallic material having a second coefficient of thermal expansion which is less than that of the first metallic material, said carrier comprising laterally spaced bulkhead members adapted to be rigidly secured to said base of said cylinder head, cylindrical tappet guides integrally formed with each of the bulkhead members, a bearing portion integrally formed at one end of each of said bulkhead members and adapted to support a camshaft for rotation about an axis substantially normal to the longitudinal axis of the associated bulkhead member, said bearing portion of each of said bulkhead members having a shoulder formed therewith for supporting a rocker shaft, and a pair of expansion bars extending between adjacent bulkhead members and designed to flex in a limited region of stress and strain so as to act as an elastic portion of the carrier to compensate for the differential rate of thermal expansion between said carrier and said base, wherein said bearing portion of each of said bulkhead members is laterally offset from each of said tappet guides.

2. A tappet and camshaft carrier of a first metallic material having a first coefficient of thermal expansion adapted to be fastened to a base forming a part of the cylinder head of an internal combustion engine made from a second metallic material having a second coefficient of thermal expansion which is less than that of the first metallic material, said carrier comprising laterally spaced bulkhead members adapted to be rigidly secured to said base of said cylinder head, cylindrical tappet guides integrally formed with each of the bulkhead members, a ring-shaped bearing portion integrally formed at one end of each of said bulkhead members and having a cylindrical opening therein adapted to support a camshaft for rotation about an axis substantially normal to the longitudinal axis of the associated bulkhead member, said bearing portion of each of said bulkhead members having a shoulder formed therewith between said cylindrical opening and said tappet guides for supporting a rocker shaft, and at least a pair of expansion bars extending between adjacent bulkhead members and designed to flex in a limited region of stress and strain so as to act as an elastic portion of the carrier to compensate for the differential rate of thermal expansion between said carrier and said base.

3. The tappet and camshaft carrier of claim 2 wherein said carrier is made of an aluminum alloy and said base is made of iron.

4. The tappet and camshaft carrier of claim 2 wherein said carrier includes a series of bulkhead members with said cylindrical openings in said bulkhead members being axially aligned and progressively smaller in diameter so as to allow said camshaft to be inserted axially into the cylindrical openings and be retained therein by a thrust plate secured to the first bulkhead member.

5. A tappet and camshaft carrier of a first metallic material having a first coefficient of thermal expansion adapted to be fastened to a base forming a part of the cylinder head of an internal combustion engine made from a second metallic material having a second coefficient of thermal expansion which is less than that of the first metallic material, said carrier comprising laterally spaced bulkhead members adapted to be rigidly secured to said base of said cylinder head, cylindrical tappet guides integrally formed with each of the bulkhead members, a ring shaped bearing portion integrally formed at one end of each of said bulkhead members and having a cylindrical opening therein adapted to support a camshaft for rotation about an axis substantially normal to the longitudinal axis of the associated bulkhead member, said bearing portion of each of said bulkhead members having a shoulder formed therewith between said cylindrical opening and said tappet guides for supporting a rocker shaft, and at least a pair of expansion bars extending between adjacent bulkhead members, each of said pair of expansion bars being formed with a "U" shaped loop portion and being designed to flex in a limited region of stress and strain so as to act as an elastic portion of the carrier to compensate for the differential rate of thermal expansion between said carrier and said base.

6. The tappet and camshaft carrier of claim 5 wherein said "U" shaped loop portion is formed at the midsection of each of said pair of expansion bars.

7. The tappet and camshaft carrier of claim 5 wherein said tappet guides are located between said pair of expansion bars.

8. The tappet and camshaft carrier of claim 5 wherein one of said pair of expansion bars interconnects adjacent bulkhead members at the end opposite the end having the bearing portion and the other of said pair of expansion bars interconnects said adjacent bulkhead members below said shoulder.

* * * * *